US005498004A

United States Patent [19]

Mariella et al.

[11] Patent Number: 5,498,004

[45] Date of Patent: Mar. 12, 1996

[54] GAME DART

[75] Inventors: Gaetano Mariella, Wayne; Ronald Kurtz, Englewood; Henry Utzinger, Ridgewood, all of N.J.

[73] Assignee: Kulite Tungsten Corporation, East Rutherford, N.J.

[21] Appl. No.: 373,870

[22] Filed: Jan. 17, 1995

Related U.S. Application Data

[63] Continuation of Ser. No. 84,420, Jun. 29, 1993, abandoned, which is a continuation-in-part of Ser. No. 769,207, Sep. 30, 1991, abandoned.

[51] Int. Cl.[6] ..... A63B 65/02

[52] U.S. Cl. ..... 273/416; 29/1.2; 29/527.2; 427/450; 427/383.7

[58] Field of Search ..... 273/416, 419, 273/420, 167 J, 81 R, 72 R, 72 A; 427/450, 453, 383.7; 29/1.2, 527.2–527.4, DIG. 23, DIG. 30

[56] References Cited

U.S. PATENT DOCUMENTS

| | | | |
|---|---|---|---|
| 1,292,953 | 1/1919 | Jeppson et al. | 106/36 |
| 1,377,960 | 5/1921 | Dodge | 106/36 |
| 1,860,561 | 5/1932 | Warner | 273/81 R X |
| 2,861,900 | 11/1958 | Smith et al. | 427/450 |
| 2,908,502 | 10/1959 | Bradstreet et al. | 273/167 J |
| 3,640,324 | 2/1972 | Porter | 273/167 J X |
| 4,713,646 | 12/1987 | Sunano et al. | 427/453 X |
| 4,778,730 | 10/1988 | Zucker | 106/36 V |
| 4,784,160 | 11/1988 | Szilagyi | 427/450 X |
| 5,271,965 | 12/1993 | Browning | 427/450 X |

FOREIGN PATENT DOCUMENTS

| | | | |
|---|---|---|---|
| 1001499 | 11/1976 | Canada | 427/450 |
| 26929 | 2/1977 | Japan | 273/167 J |
| 4066341 | 5/1979 | Japan | 427/450 |
| 510193 | 7/1939 | United Kingdom | 273/420 |
| 547946 | 9/1942 | United Kingdom | 273/167 J |
| 2000815 | 1/1979 | United Kingdom | 427/450 |
| 1579190 | 11/1980 | United Kingdom | 273/416 |
| 2219218 | 12/1989 | United Kingdom | 273/416 |

*Primary Examiner*—Paul E. Shapiro
*Attorney, Agent, or Firm*—Plevy & Associates

[57] ABSTRACT

A dart barrel having a surface coating applied thereto that provides the dart barrel with an increased resistance to wear and an increased coefficient of friction. The surface coating is sprayed onto the dart barrel in a semi-molten form. The dart barrel is then heat processed wherein the dart barrel is heated and the material of the surface coating and material of the dart barrel diffuse into each other bonding the two materials together.

14 Claims, 2 Drawing Sheets

GAME DART

This is a continuation of application Ser. No. 08/084,420, filed on Jun. 29, 1993, entitled GAME DART, abandoned, which is a continuation-in-part of prior application Ser. No. 07/769,207, filed on Sep. 30, 1991, abandoned.

FIELD OF THE INVENTION

The present invention relates to a dart that is thrown by hand at a dart board during a game of darts and, more particularly, to a dart having a barrel portion with an enhanced gripping surface.

BACKGROUND OF THE INVENTION

The game of darts, wherein a player, standing at a distance from a marked board, throws a dart into the board, has been played for many years. Darts is a game of skill in which players score points based upon their ability to control where the thrown dart strikes the board. As with many games of physical skill, the equipment has, over the years, undergone refinement to provide the player with the purest possible game, that is, to eliminate defects in the equipment so that the only source of variability is the player himself. The darts used have become increasingly sophisticated with respect to materials, shape and weight distribution. Modern darts typically include a metal barrel having a point at one end and a threaded aperture at the opposite end, a metal, plastic or wooden shaft, threadably received within the aperture of the barrel and the "flight" or flying fins of the dart.

The most critical part of a dart is its barrel. The barrel of the dart is the only part of the dart held by a dart player, thus all the skill and forces used in propelling a dart are transferred to the dart through the barrel. The barrel also is the predominant factor in giving a dart its weight, shape and strength. As such, the quality of the barrel essentially determines the quality of the dart. One of the most important features of a dart is its gripped surface. Often the gripped surface of the barrel is textured so that a player can firmly grip and throw the dart without his/her grip slipping.

Prior art methods of texturing the barrel of a dart are expensive. The textured pattern is either machined onto the barrel or is formed with the barrel in a complex molding or forging procedure. Such prior art methods of texturing have the disadvantage of becoming uneven with time, either because the tool wear or the wearing of the texture itself. Additionally, such prior art texturing methods have limits in how small or fine the details of a textured pattern can be made. Consequently, the coefficient of friction created by such a textured pattern is also limited.

It is therefore an object of the present invention to provide a dart having an optical barrel gripping surface.

It is a further object to provide the aforesaid surface at minimal cost.

It is yet another object to provide a wear resistant dart barrel gripping surface.

SUMMARY OF THE INVENTION

The above-indicated problems and disadvantages associated with conventional throwing darts and the techniques for their manufacture are overcome by the present invention which includes a dart barrel covered by a surface coating of material that has a higher resistance to wear than does the barrel its coats. The surface coating is bonded to the exterior of the barrel by a diffusion bond, thereby providing a surface coating that reinforced by the material of the barrel. The surface coating is first applied to the dart barrel by being sprayed onto the dart barrel in a semi-molten form. The spraying of the semi-molten material creates a textured pattern on the dart barrel that greatly increases the coefficient of friction for the dart barrel. The dart barrel is then heated to a temperature that enables the material of the surface coating and the material of the barrel to diffuse into each other along a common interface, bonding the surface coating to the dart barrel.

As the surface coating is sprayed onto the exterior of the dart barrel, a skeletal structure having an interconnecting porosity is created. As such, when a person grasps the dart barrel any moisture or oils on the person's fingers can pass into the porous surface coating. Consequently, the contaminants are removed from the skin-to-dart interface and the coefficient of friction created by the texture of the surface coating is maintained.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
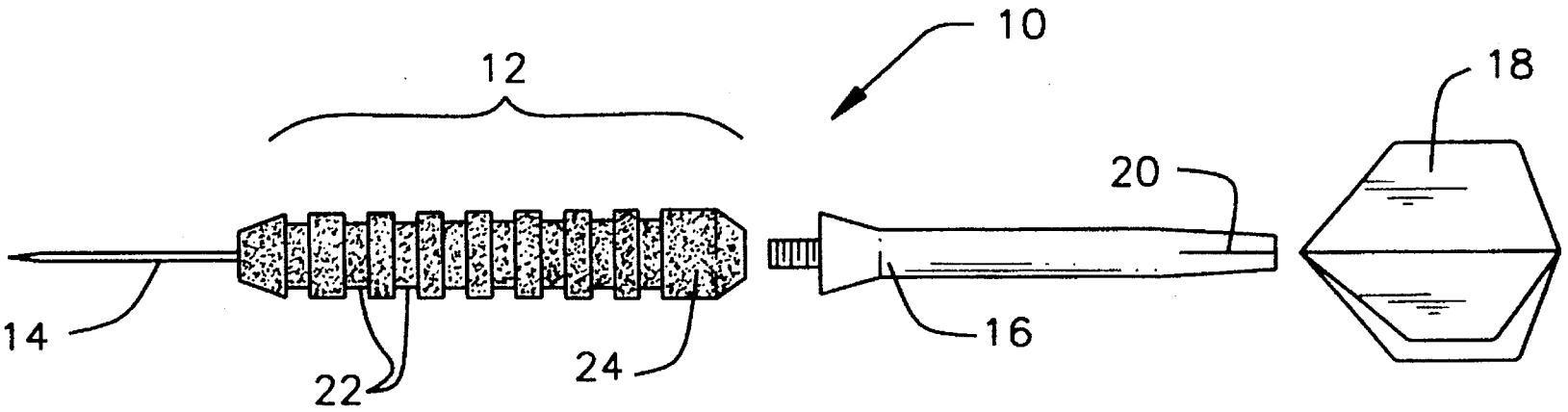
FIG. 1 shows a dart that includes a dart barrel made in accordance with one preferred embodiment of the present invention.

Referring to FIG. 1, a dart 10 is shown that includes a dart barrel 12 coated with a material that increases the wear resistance of the dart barrel and increases the coefficient of friction along the dart barrel. Other than the formation of the dart barrel 10, the shown embodiment of the dart 10 is conventional. The dart 10 includes a point 14 that extends from one end of the dart barrel 12. A shaft 16 extends from the opposite side of the dart barrel 12 that leads to the flight 18. The flight 18 is typically received in slots 20 formed at the end of the shaft 16 and are retained therein by friction. It will be understood that other conventional dart configurations exist in the prior art. However, the shown configuration is most common for tournament quality darts.

In the shown embodiment, the dart barrel 12 is preferably made of tungsten. However, other heavy materials such as brass and the like may also be used. The dart barrel 12 may be formed to be cylindrical and smooth or may have any textured pattern formed along outer surface of the dart barrel 12 to enhance the aesthetic value of the dart barrel 12. In the shown embodiment, the dart barrel 12 is aesthetically enhanced by the presence of parallel annular grooves 22 that are periodically disposed along the length of the dart barrel 12. A surface coating 24 is applied over the dart barrel 12, thereby completely covering the material of the dart barrel 12. The surface coating 24 has a resistance to wear and a coefficient of friction that is greater than that of the dart barrel 12 itself. However, the surface coating 24 has a fineness of texture that enables the surface coating 24 to be applied to the dart barrel 12 without adversely affected the aesthetic value of the textured pattern present on the dart barrel 12. The surface coating 24 is also preferably porous. As such, the surface coating 24 acts to remove moisture from a finger-to-dart interface with a wick-type action as a person grasps the dart barrel 12. Since metal often becomes slick when coated with water and/or skin oils, the wicking action of the porous surface coating 24 helps a person to better maintain his or her grip on the dart barrel 12 while throwing the dart 10.

The surface coating 24 can be formed from any material that is harder and has a higher coefficient of friction than does the material of the dart barrel 12. In a preferred embodiment, the surface coating 24 is made of tungsten carbide, however, silicon carbide and aluminum oxide also are suitable selections as are many other metals and ceramics. For purposes which will be later explained, alloy agents may also be mixed with the primary material of the surface coating 24 to help enhance the ability of the surface coating to be diffused within the material of the dart barrel 12. Ceramic materials tend to be more brittle than the metals used in the dart barrel construction. If such materials were just applied to the metal dart barrel 12 as a independent layer, there would exist the possibility that the surface coating 24 could break away from the dart barrel 12 as the dart barrel 12 flexed or as the surface coating 24 is impacted. As a result, the present invention dart barrel 12 is coated with a surface coating 24 that is diffused into the material of the dart barrel 12 at the barrel-to-coating interface. This bonds the surface coating 24 to the material of the dart barrel 12 and prevents the surface coating 24 from separating from the dart barrel 12.

Figure 2:
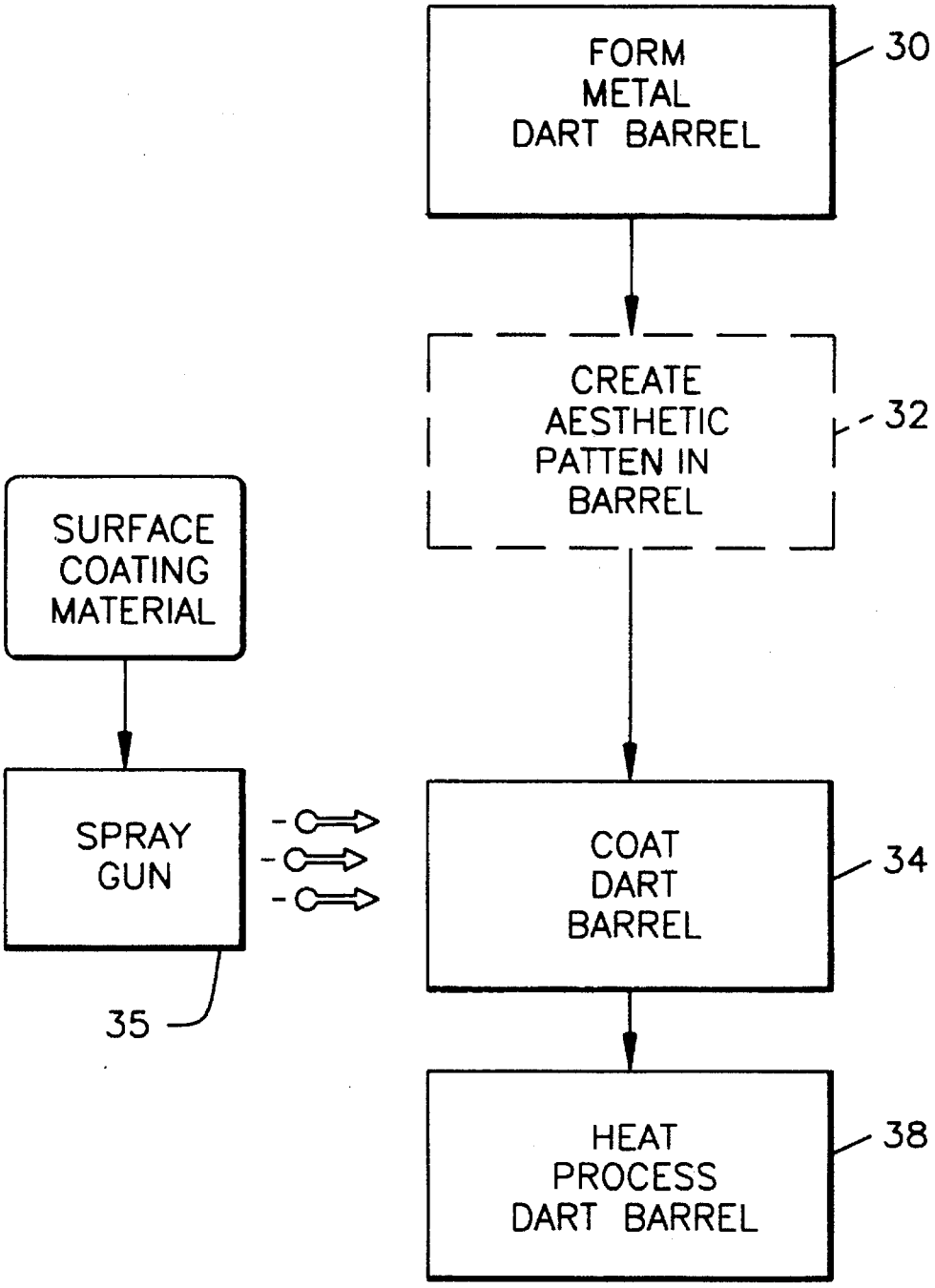
FIG. 2 is a block diagram illustrating one preferred method for manufacturing the present invention dart barrel.

Referring to FIG. 2, a block diagram is provided that shows the method of forming the present invention dart barrel. First, as is indicated by block 30 of the diagram, a dart barrel is made of metal or a metal alloy using known manufacturing techniques such as cold forging, die casting, machining stock material or the like. When manufacturing the dart barrel, an aesthetic design may be created directly into the dart barrel depending upon which manufacturing technique is used. Referring to the second block 32 of the diagram an optional step is shown, wherein an aesthetic design is created in the dart barrel if the aesthetic design was not originally made part of the dart barrel during its formation. During this optional step, an aesthetic design may be machined into the dart barrel or an aesthetic design can be stamped into material of the dart barrel. Alternatively, the dart barrel may just be machined to exacting tolerances and a aesthetic design need not be added.

Referring to block 34 of the shown diagram, it can be seen that a surface coating is applied to the dart barrel directly over any aesthetic design that may or may not be present on the surface of the dart barrel. The surface coating is applied with a particle size and coating thickness such that the surface coating covers the dart barrel without significantly detracting from the appearance of any below lying aesthetic design. Consequently, a textured aesthetic design is formed on the dart barrel. Prior to the present invention, the formation of a textured aesthetic design would require either expensive complex tooling or a large amount of machinery time. Both of which, add significantly to the cost of manufacturing darts with such a textured aesthetic design.

In the preferred embodiment, the surface coating is applied to the dart barrel using a plasma spray device 35. Surface coating material such as tungsten carbide, silicon carbide, aluminum oxide or other ceramic materials, with or without alloy agents, can be fed into the plasma gun device 35, wherein the coating material is melted and sprayed in molten form onto the dart barrel. The output of the plasma spray device 35 is adjustable via the adjustment of the electric arc intensity within the spray device, the position of the device, the gas flow rate and the spray coating material feed rate. In a preferred setting the plasma spray device 35 is set at a relatively low temperature and gas flow pressure for a given coating material. As such, the output of the plasma spray device 35 is not a fine liquified mist, but rather the particles sprayed are only semi-molten. Consequently, the sprayed particles create a rough texture on the dart barrel.

A flame spraying device can be used in place of the plasma spray device wherein the flame spray device liquifies the spray coating material with gas combustion. However, plasma spray devices are preferred over flame spraying device because they use electricity as the source of heat, rather than the combustion of gases. Plasma spray devices therefore eliminate the combustion by-product contamination of the deposited surface coating created by the burning of the combustion gases.

After the surface coating is applied to the dart barrel, the material of the dart barrel and the material of the surface coating represent two distinct layers on the dart. Since the surface coating is preferably a ceramic material, it is typically more brittle than the below lying dart barrel and is vulnerable to breaking away from the dart barrel. As can be seen from block 38 of the diagram, the dart barrel, with its newly applied surface coating, is heat treated. The dart barrel is heated to a temperature wherein the atoms of the surface coating begin to diffuse into the material of the dart barrel and vice versa. For example, a tungsten dart barrel coated with a tungsten carbide surface coating will be heated to a temperature of between 1150° celsius and 1400° celsius for between one and six hours, depending upon the temperature. The dart barrel may be heated in an inert atmosphere or a reducing atmosphere, such as hydrogen gas, to prevent oxidation. This heat treatment diffuses the tungsten carbide into the tungsten at the barrel-to-coating interface, thereby bonding the surface coating to the dart barrel at the atomic level. This diffusion bonding prevents the surface coating from separating from the dart barrel and greatly increases the strength and flexibility of the surface coating. To promote the diffusion of the surface coating into the dart barrel an alloy agent may be mixed within the primary material of the surface coating, wherein the alloy agent helps the diffusion characteristics of the surface coating.

As ceramic material, such as tungsten carbide, is deposited onto the dart barrel, a porous coating is formed. The porous nature of the spray coating is not lost during the heat treatment of the dart barrel. As a result, a skeleton structure having an interconnected porosity is formed that extends through the surface coating down to the barrel-to-coating interface. As a person grasps a dart, his or her fingers are coated with skin oils and may be wet with perspiration or another liquid. The presence of such oil and moisture on a persons fingertips reduces the coefficient of friction between the person's fingers and any object that person grasps. In a traditional metal dart barrel, the presence of the oil and moisture contaminants may cause a person's fingers to slip from the dart barrel as the dart is thrown, thereby effecting the performance of the thrower. In the present invention, the porous nature of the surface coating channels moisture and oil away from finger-to-dart interface much in the same manner that threads on tire channel water away from the tire-to-road interface. Liquid contaminants on the fingers pass into the porous skeletal structure, thereby removing those contaminants from the point of contact with the finger. As a result, the surface coating increases the coefficient of friction for the dart beyond that available from non-porous surface coatings.

Plastics can also be used in the surface coating, although the wear properties of the plastic would not be as advantageous as a metal or ceramic coating. Plastics are easily adapted to molten spray techniques because of its low melting point. Plastics have the additional advantages of coming in a variety of colors, being inexpensive, and being highly resistant to the environmental pollutants such as oil, water and other substances. Plastics can also be applied to the barrel of a dart as a powder coating. In powder coating, a metal part is heated and then exposed to an environment of powdered plastic. The plastic contacts the metal part, melts and adhere to its surface. Thus, a metal piece is quickly enveloped in plastic. When plastic epoxies are used, wear resistance of the coating can approach that of metal or ceramic coatings. However, the use of powder coating gives for more flexibility as to color and texture of the coating and power coating is extremely inexpensive to use.

The methods of texturing dart barrels, as discussed have many advantages. One advantage is that by combining or adjusting the texturing techniques, a manufacturer can take one supply of darts and texture the dart barrels in an infinite variety of styles, colors and textures. Consequently, the manufacturing options of creating textured darts is greatly expanded without having to spend large amounts of money or time to change the tooling for traditional texturing procedures.

Thus, the present invention provides an economical method for producing wear resistant and suitably rough surface on the barrel of a dart that does not detract from an aesthetic designed present on the barrel. It should be understood that the embodiments described herein are merely exemplary and that a person skilled in the art may make many variations and modifications without departing from the spirit and scope of the invention as defined in the appended claims.

What is claimed is:

1. A method of manufacturing a dart barrel with a wear resistant textured gripping surface, said method comprising the steps of:

forming a dart barrel from a metallic material of a given hardness;

providing a particulate material;

heating said particulate material into a semi-molten state;

spraying said particulate material in said semi-molten state onto an outer surface of said dart barrel to form a textured porous coating thereon, wherein said textured porous coating removes moisture from a finger-to-dart barrel interface with a wick-type action when a person's fingers grasp said dart barrel; and heating said dart barrel to diffuse said particulate material into said outer surface thereof to bond said coating of particulate material to said dart barrel at the atomic level.

2. The method according to claim 1, wherein said step of spraying comprises plasma spraying.

3. The method according to claim 1, wherein said step of spraying comprises flame spraying.

4. The method according to claim 1, wherein said step of heating is performed in an atmosphere which substantially prevents oxidation at said outer surface of said dart barrel.

5. The method according to claim 1, wherein said particulate material is selected from a group consisting of ceramics, metals and plastics.

6. The method according to claim 1, wherein said particulate material is selected from a group consisting of tungsten carbide, silicon carbide and aluminum oxide.

7. The method according to claim 1, wherein said particulate material has a hardness that is greater than said given hardness of said barrel.

8. The method according to claim 1, wherein said step of forming said dart barrel includes simultaneously forming an aesthetic pattern in said outer surface of said dart barrel, wherein said coating of said particulate material applied to said dart barrel conforms to said aesthetic pattern.

9. The method according to claim 1, further comprising the step of forming an aesthetic pattern in said outer surface of said dart barrel immediately after said step of forming said dart barrel, wherein said coating of said particulate material applied to said outer surface of said dart barrel conforms to said aesthetic pattern.

10. A dart barrel for a dart, comprising:

a metal dart barrel of a given hardness having an outer surface of a given coefficient of friction; and a textured porous coating of particulate material diffusion bonded to said outer surface of said metal dart barrel, wherein said textured porous coating provides said metal dart barrel with a gripping surface having a greater coefficient of friction than said outer surface and removes moisture from a finger-to-dart barrel interface with a wick-type action when a person's fingers grasp said dart barrel.

11. The barrel according to claim 10, wherein said coating of particulate material has a hardness which is greater than said given hardness of said metal dart barrel.

12. The barrel according to claim 10, wherein said metal barrel comprises tungsten and said coating of particulate material is selected from a group consisting of tungsten carbide, silicon carbide, and aluminum oxide.

13. The barrel according to claim 10, wherein said coating of particulate material is selected from a group consisting of ceramics, metals, and plastics.

14. The barrel according to claim 10, wherein said outer surface of said dart barrel defines an aesthetic pattern and said coating of said particulate material conforms to said aesthetic pattern.

* * * * *